United States Patent [19]

Cole et al.

[11] Patent Number: 4,514,266

[45] Date of Patent: Apr. 30, 1985

[54] METHOD AND APPARATUS FOR ELECTROPLATING

[75] Inventors: Frank J. Cole; Henry N. Hahn, both of Parma, Ohio

[73] Assignee: Republic Steel Corporation, Cleveland, Ohio

[21] Appl. No.: 301,429

[22] Filed: Sep. 11, 1981

[51] Int. Cl.[3] ..... C25D 7/06; C25D 17/12

[52] U.S. Cl. ..... 204/28; 204/14.1; 204/206; 204/237; 204/275; 204/284

[58] Field of Search ..... 204/28, 55 R, 206–211, 204/237, 275, 284, 14.1

[56] References Cited

U.S. PATENT DOCUMENTS

| | | | |
|---|---|---|---|
| 4,169,780 | 2/1979 | Stiker et al. | 204/206 |
| 4,183,799 | 1/1980 | Sellitto et al. | 204/206 |
| 4,347,115 | 8/1982 | Espenhahn | 204/206 |
| 4,367,125 | 1/1983 | Avellone | 204/28 |

*Primary Examiner*—G. L. Kaplan
*Assistant Examiner*—W. T. Leader
*Attorney, Agent, or Firm*—Watts, Hoffmann, Fisher & Heinke Co.

[57] ABSTRACT

A method and apparatus for quality high speed electrical plating of one or both sides of a metallic workpiece 12 wherein a combined consumable-non-consumable anode system so provides a uniformity of metallic deposition at relatively high speeds irrespective of the consumable anode 15 contour. A metal ion containing plating solution flows into contact with a workpiece through apertures 86 in the non-consumable anode 16 while metal ion concentration is maintained. The consumable-non-consumable anode system is used in a vertical or horizontal submerged cell configuration.

16 Claims, 5 Drawing Figures

METHOD AND APPARATUS FOR ELECTROPLATING

TECHNICAL FIELD

This invention relates to the electrode deposition of a metal coating on a metallic substrate and more particularly to electroplating a metallic workpiece in a cell which utilizes a consumable/non-consumable anode system.

BACKGROUND ART

Forming a protective coat of one metal on a second metallic substrate workpiece is well known.

Electroplating or electrogalvanizing is a known method for forming a protective coating of one metal upon a metallic workpiece. Generally in galvanizing a steel workpiece forms a cathode in an electroplating cell containing an electroplating solution which carries metal ions. An anode, which in galvanizing is usually zinc, is positioned in a spaced apart relationship with the workpiece. Upon application of direct current to the cell, zinc ions in the electroplating solution are plated onto the cathodic workpiece as elemental metal. Simultaneously zinc from the anode undergoes electrochemical dissolution to the metal ion, thus replenishing the zinc ions in the electroplating solution.

There are problems in electroplating, especially with the use of so called consumable anodes. For economic and quality reasons it is preferred that no more than a minimum required thickness of the coating metal be deposited on the metallic workpiece. Deviation can cause "weak spots" in the coating.

The achievement of a uniform coating on the workpiece depends upon a number of factors. One of the most significant is uniformity of current density across the workpiece plating surface. Metal ion concentration proximate the workpiece plating surface as well as uniformity of metal ion concentration in a given volume of electroplating solution are also significant factors.

As the anode is consumed the spacing between the anode and the workpiece changes causing changes in the anode to workpiece spacing and attendant changes in the current density. In addition, the consumable anode is not homogeneous and undergoes electrochemical dissolution, unevenly. This uneven dissolution or "contouring" of the anode surface produces non-uniform change of the distance between the workpiece and the anode, with the result that the current desnity changes are uneven across the workpiece plating surface. This phenomenon can cause variations in the thickness of the coating. Further, as the current density changes unevenly across the anode surface it causes an even greater discontinuity in the dissolution.

It has been suggested that non-consumable anodes, i.e. those which are electrically conductive but substantially chemically inert in the electroplating cell, be utilized in order to maintain a constant anode to workpiece spacing across the workpiece plating surface. As with a consumable anode, a potential difference is maintained between the non-consumable anode and the workpiece such that metal ions in the electroplating solution are plated onto the workpiece as elemental metal. As the metal ions are reduced to their metallic state to plate the workpiece, the electroplating solution adjacent or proximate the workpiece becomes depleted of the metal ions. Unless the solution is continually replenished and agitated at the workpiece plating surface so that the ion concentration is maintained, plating will not be consistent. Since a non-consumable anode does not replenish plating ions, as does a consumable anode, the metal ions in the plating solution are replenished from a source remote from the cell.

The use of a non-consumable anode is shown in our co-worker's pending application, SN 217,806 filed Dec. 18, 1980 under the title, "Apparatus and Method for Plating One or Both Sides of metallic Strip" now U.S. Pat. No. 4,367,125 which is incorporated by reference. The anode disclosed in that application includes a series of apertures through which plating solution flows to contact a strip to be plated.

In order to obtain high electrical efficiency and to maintain quality control, the gap or distance between the workpiece plating surface and the anode should be minimized. The effect of minimizing the gap is to limit the volume of plating solution and metal ions near the workpiece and available for plating the workpiece. Thus, this close spacing requirement further limits the ability to achieve efficient, continuous, electroplating using non-consumable anodes. The problems of replenishing or maintaining the plating ion concentration has inhibited performance of many prior non-consumable anode systems with the result that they have not enjoyed abundant commercial success.

For various reasons in recent times applications have developed where it is desirable to plate only one surface of a workpiece or apply coatings of different thicknesses on opposed strip surfaces. For example, single surface coated steel materials are used or proposed for wall panels, buildings, and automotive components. Automotive steel rocker panels for example, frequently are desirably heavily electrogalvanized on their internal surfaces to inhibit corrosive attack while external surfaces desirably are smooth and uncoated or thinly coated so one can produce a high quality appearance in the auto's finish.

One technique for such one side plating is disclosed in the referenced application. Another technique seeks to use a conventional electrolytic strip plating line modified to maintain the level of plating solution at a level where it contacts only the lower surface of the workpiece being plated. A further technique for single side plating masks one surface while plating the other. In this method the workpiece is reeved over rollers that are partially immersed in a plating bath. Such rollers function to mask the workpiece surface which they contact as the opposite surface is plated.

It has also been proposed to use multiple electrodes in an electroplating cell. Generally, attempts at using multiple anode systems and especially non-consumable anode systems have resulted in bi-polar plating action. Bi-polar plating action occurs when the electrical potential between anodes causes deposition of metal on the surface having the lower potential. The lower potential anode acts as a cathode in a cell with the higher potential anode, resulting in a decrease in plating efficiency.

If these and other problems of multiple anode plating could be overcome, it would be advantageous to have a system wherein the advantages of the non-consumable and consumable anodes could be achieved simultaneously.

DISCLOSURE OF THE INVENTION

The present invention uses an improved consumable/non-consumable anode containing plating system and technique which is especially adapted for continuous electroplating of a moving metallic workpiece. It has been discovered that quality electroplating of one or both sides of a metallic workpiece can be accomplished in electroplating cells by utilization of a configured consumable/non-consumable anode system.

The instant invention provides an improvement in prior art electroplating cell by utilization of a configured consumable/non-consumable anode system spaced in relation to the cathode workpiece. The distance between a consumable anode and the workpiece is greater than the distance between a non-consumable anode assembly and the workpiece. The electrical potential between the consumable anode and the workpiece is at least as great as that between the non-consumable anode assembly and the workpiece.

According to the invention, a non-consumable anode assembly is positioned in a relatively closely spaced apart relationship with the cathodic workpiece to define a space which acts as a first plating flow path for electroplating solution. The plating solution is caused to flow within the first plating flow path in a quantity sufficient to maintain a substantially constant plating current density so that plating is accomplished continuously and uniformly along the entire plating surface of the workpiece.

A consumable anode is positioned outside the first plating flow path in a spaced apart relationship with the cathodic workpiece such that a second flow path is formed wherein the electroplating solution is caused to flow between the consumable anode and the workpiece via the first path in quantities sufficient continuously to replenish the metal plating ion in the first path and provide a uniform metal ion concentration.

A potential is applied across the cell such that the potential between the consumable anode and the workpiece is at least as great as that between the non-consumable anode assembly and the workpiece. In this manner a uniform plating current density is provided which is effective in forming an even coating across the workpiece plating surface regardless of the consumable anode dissolution contour. At the same time, the electrochemical dissolution of the anode provides substantial replenishment of metal plating ion proximate the plating surface of the workpiece. There is little or no bipolar effect.

In accordance with the method of the instant invention, electroplating solution is supplied to the first plating flow path in a quantity sufficient to maintain the first electroplating flow path substantially filled at all times with moving solution such that an even, constant electroplating current flow is provided. Simultaneously, electroplating solution is supplied to the second flow path in quantities sufficient to electrochemically dissolve the consumable anode while providing an electroplating current between the workpiece surface to be plated and the consumable anode.

In accordance with one aspect, electroplating solution is pumped through the first plating flow path and the second flow path simultaneously to bathe both anodes and the workpiece. The moving solution then drops into a sump where it is collected, sent to a metal plating ion replenishment station, recirculated through a filter and returned to the cell. It has been found that in accordance with this embodiment high flow rates are required.

In accordance with another embodiment which can be either vertical or horizontal, electroplating solution contained in the cell is agitated or otherwise caused to flow within the first plating flow path as well as the second flow path. The flow in the first plating flow path is regulated to provide a uniform electroplating current density and continual replenishment of metal ion concentration within the electroplating solution while the flow in the second flow path is maintained to provide dissolution of the consumable anode to continually replenish metal plating ions proximate the workpiece.

In a preferred embodiment of the invention, the non-consumable anode plating surface is generally parallel to the workpiece surface to be plated and contains a plurality of orifices or apertures through which the flowing electroplating solution passes. Electroplating solution is moved to pass over the consumable anode into the second flow path, through apertures in the non-consumable anode plating surface then into the first plating flow path. Thus fresh solution is caused to contact the metal workpiece surface and substantially to fill the first plating flow path. As the metal workpiece moves past the anode, an electroplating current density is maintained by the potential between both anodes and the workpiece, causing plating to occur uniformly on the surface to be plated.

One side of a metal workpiece can be plated to the substantial exclusion of the other by positioning the consumable/non-consumable anode system opposing the side to be plated. Thus acceptable single side plating can be accomplished. Alternately, consumable/non-consumable anode systems may be positioned on both strip sides to provide two sided plating with a differential plating capability.

To further insure uniform plating thickness across the width of the strip, masking plates are inserted in the path of electroplating solution which are electrically insulating and reduce plating current at the strip edges to reduce two undesirable phenomena known as "tree growth" and "edge buildup". When using a plurality of non-consumable anode assemblies, masks are inserted between adjacent anodes to inhibit plating current from flowing between the non-consumable anodes and thus inhibit bi-polar plating of the lower potential anode. The use of a single non-consumable anode on each side of the strip to be plated inhibits bi-polar plating, as compared to use of plural adjacent anodes.

These and other features of the present invention will become more apparent as the invention becomes better understood from the detailed description that follows, when considered in connection with the accompanying drawings.

BEST MODE FOR CARRYING OUT THE INVENTION

Figure 1:
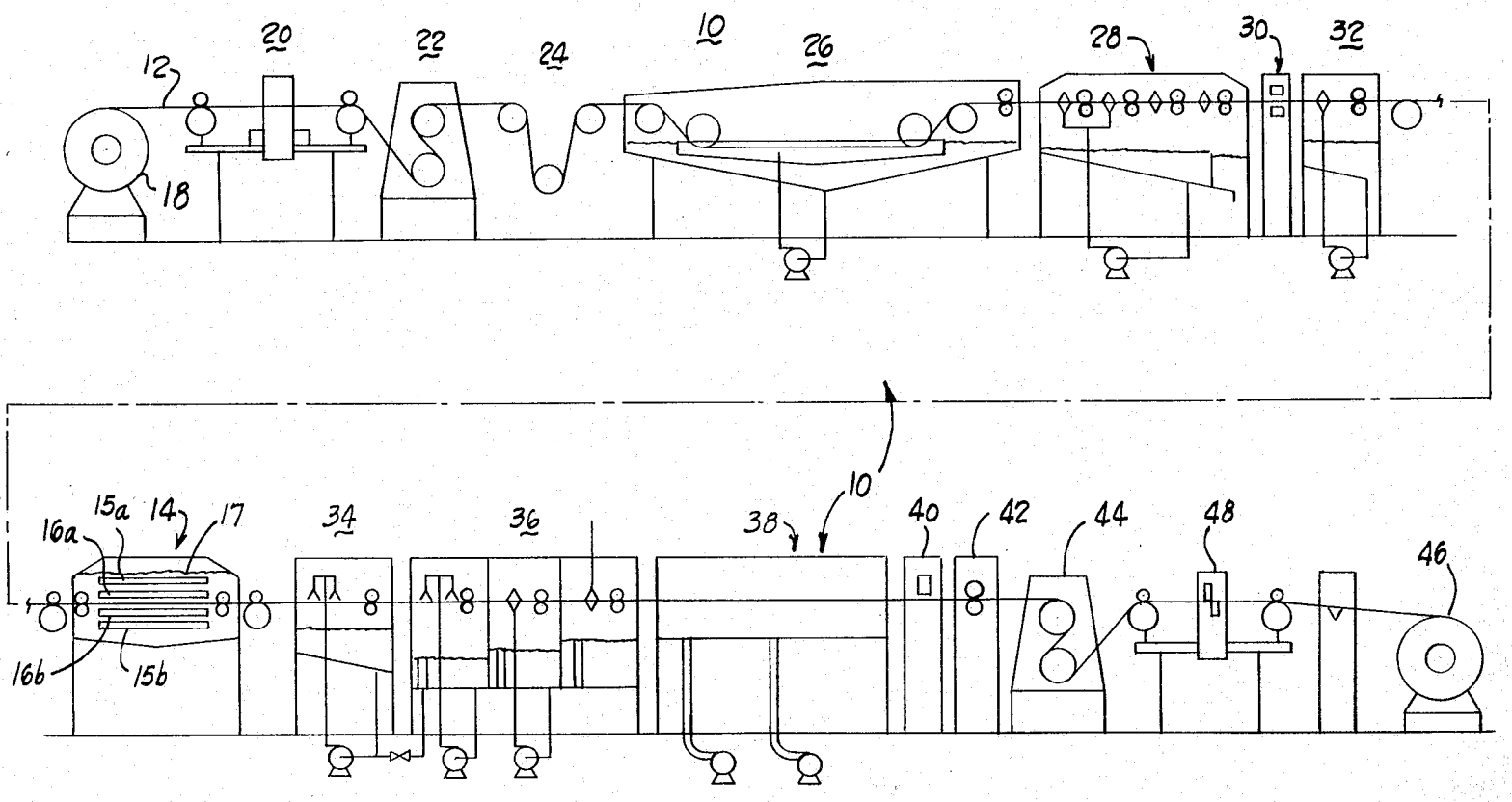
FIG. 1 is a schematic illustration of a plating line incorporating the present invention.

Turning now to the drawings, FIG. 1 schematically shows a plating line 10 which is particularly suited for applying a zinc coating to one or both sides of a steel strip 12. A plating section 14 comprising a portion of the line includes a number of electrodes 15 and 16 mounted both above and below the strip. The electrodes 16 are non-consumable anode assemblies while the electrodes 15 are consumable anode assemblies. In a horizontal cell those anodes 16*a* and 15*a* positioned above the strip plate 12 provide an electroplating current flow through the electroplating solution 17 to plate metal onto the strip's upper surface and those anodes 16*b* and 15*b* positioned below the strip 12 provide a similar electroplating current flow for plating the strip's lower surface.

A number of preparatory steps upstream of the plating section are performed prior to plating. The strip 12 is fed along its path of travel from payoff reel 18 to a welding station 20 where the end of one strip is welded to the beginning of the next to form a strip for continuous plating operation. During the welding step strip motion is stopped at the welding station in a known manner.

From the welding station 20 the strip is fed through a drag bridle roll 22 and a strip tracking control 24. The drag bridle roll 22 maintains tension in the strip and the tracking control 24 assures that the strip is centered along its path of travel.

After exiting the tracking control the strip is fed through an acid cleansing bath 26 of a suitable acid such as hydrochloric. The acid removes foreign substances and/or oxides from the steel and prepares the steel surface for electroplating. The strip exiting the acid cleansing bath 26 is rinsed to remove and neutralize residual acid at scrubber/rinse station 28.

The centering of the strip is checked at a track monitoring station 30 and, if off center, corrective steps are taken at the tracking control station 24 to recenter it.

Immediately prior to entering the plating section 14 a metal ion spray is applied at a strip conditioner station 32. Application of the metal ion spray causes enhanced plating performance by wetting the surface to be plated and acting as a seed for the plating process.

After one or both of the strip's surfaces are plated by a process in accordance with the invention to be more fully described, the strip leaves the plating section 14 and enters a metal ion reclaiming station 34. At this station metal ion which was caused to come out of the plating bath but was not bonded to the strip is collected. The strip 12 is then rinsed and dried at a rinsing station 36 and a drying station 38 respectively.

The coating weight of the dry strip is measured at a coating weight station 40. If the coating weight is not equal to a desired value corrective measures are taken. These measures include strip speed adjustment and changing relative electrical potential between the strip and the respective anodes, and changing the potential difference between some or all the anodes and the strip.

After the strip is tested for coating weight it passes through a brush wipe 42 and an exit bridle roll 44 and completes its path of travel when it is stored on a take up reel 46. Periodically the strip is cut by an exit shear 48, a full coiling reel is removed, and an empty coiling reel is positioned for receiving more coated strip.

As a galvanizing process begins, a suitable zinc electroplating solution with a pH ranging upward to about 3.0 preferably in the range of about 1.0 to about 2.5 and having temperature greater than ambient and preferably from about 45° C. to about 65° C. is prepared using, for example, technical grade zinc sulfate salts. The electroplating solution is purified using carbon and zinc dust. The zinc sulfate salts disassociate and supply the zinc metal plating ion.

When appropriate potentials are applied to the workpiece and the consumable/non-consumable anodes a reaction occurs in the cathode following the well known reaction $2e^- + Zn^{++} \rightarrow Zn^o$. The electrons necessary to complete this reaction are caused to flow through the anodes.

Figure 2:
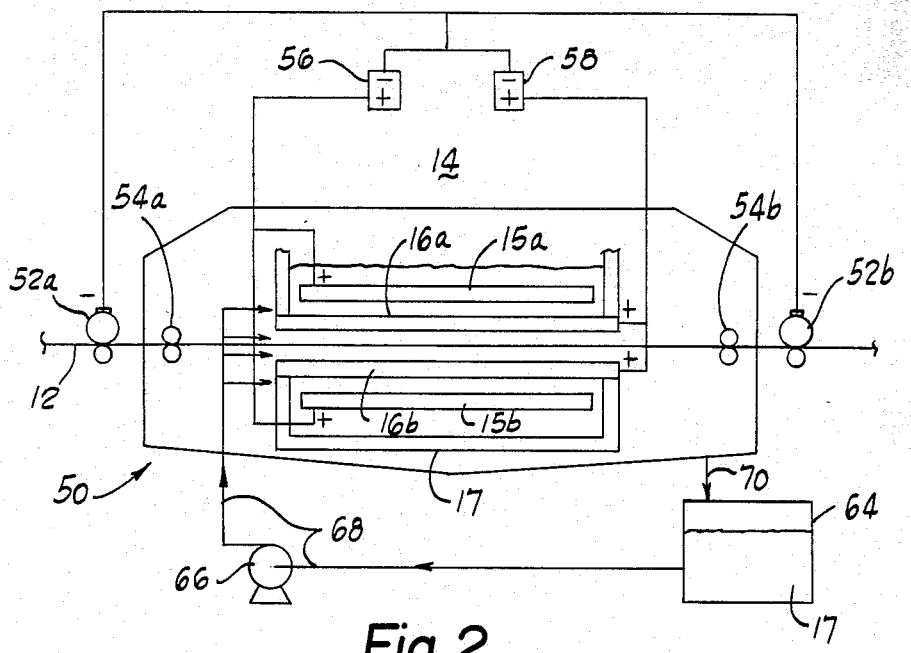
FIG. 2 is an enlarged schematic illustration of a horizontal electroplating cell incorporated in the plating line of FIG. 1.

Referring to FIG. 2, the plating section is configured such that the moving, horizontal steel strip 12 is substantially bathed in an electroplating solution 17 and flow off the workpiece is collected in a tank part of a cell 50. The anodes 15*a* and 16*a* and 15*b* and 16*b* are disposed, respectively, above and below the strip 12. A replenishment reservoir 64 containing zinc ion replenishment solution is connected to the cell 50 through conduit 68 by means of pump 66. Fluid return conduit 70 provides for the return flow from the cell 50 to the reservoir 64. An electrical supply system includes a consumable anode power supply 56 and a non-consumable anode power supply 58. The negative terminals of the power supplies 56 and 58 are interconnected with each other as well as with contact rollers 52*a* and 52*b*. The positive terminal of power supply 56, is connected with the consumable anodes 15*a* and/or 15*b*; and, the positive terminal of power supply 58, is connected with the non-consumable anode 16*a* and/or 16*b*.

In operation, electroplating solution 17 is circulated from the reservoir 64 into the cell 50. The solution 17 enters the cell and flows over the workpiece and the anodes to exit the cell 50 through the conduit 70 and return to the reservoir 64.

The power supply 58 is energized establishing a potential between the strip 12 and the non-consumable anodes 16*a* and/or 16*b*. The power supply 56 is energized establishing a potential between the strip 12 and the consumable anodes 15*a* and/or 15*b* which is as great or greater than the potential between the strip 12 and the non-consumable anode 16*a* and 16*b*. The strip 12 is conveyed through the cell 50 by drive rollers 54*a* and 54*b* and is brought into intimate contact with the contact rollers 52*a* and 52*b*. The gaps between the anodes 16*a* and 16*b* and the strip 12 as well as the gaps between the anodes 15*a* and 15*b* and the strip 12, along with the speed at which the drive rollers 54*a* and 54*b* move the workpiece through the cell 50, are regulated together with the relative potential between the anodes and the strip to determine plating thickness, uniformity and cell efficiency.

The apparatus of FIG. 2 as thus far described contemplates equal plating of both sides of the strip. When differential plating is desired additional power supplies to regulate the top consumable non-consumable anode system 16*a* and 15*a* independently from the bottom non-consumable consumable anode system 15*b* and 16*b* will be employed. Likewise, when one side coating is desired the top or bottom set of anodes will not be energized. Because of throw around phenomenon when coating one side it is preferred to mask the side not being coated as well as an edge portion of the strip in order to prevent edge buildup. A fragmentary portion of one mask is shown at M in FIG. 4. Other suitable masking is shown in the referenced application.

Figure 3:
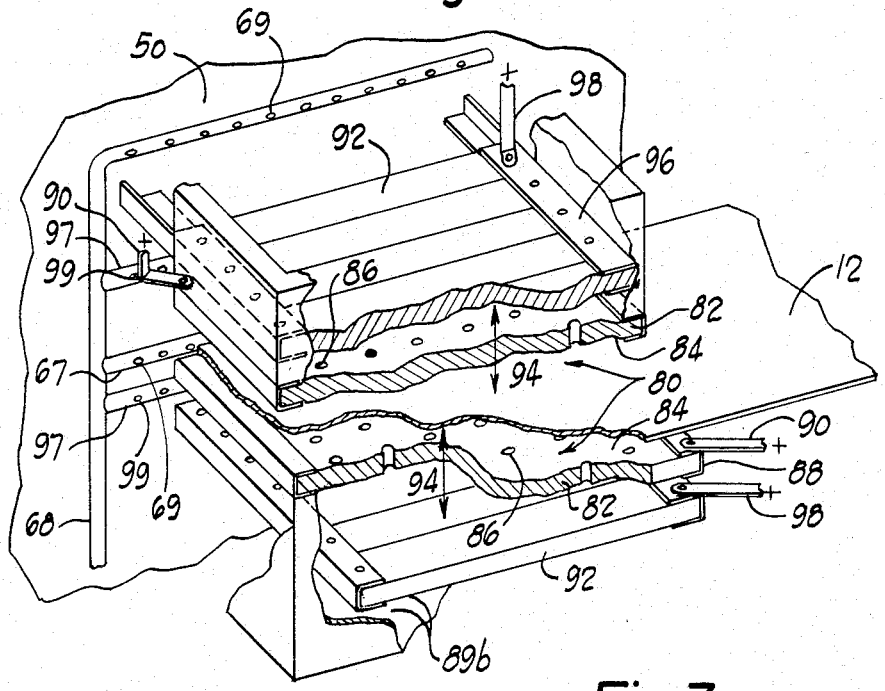
FIG. 3 illustrates a fragmentary, perspective view of a configuration of the structure of the cell of FIG. 2.

FIG. 3 is a cut away perspective view of the cell 50 wherein the consumable/non-consumable anode system suspended above strip 12 is substantially identical to that suspended below strip 12 and like numerals are used to identify like elements. A rectangular shaped non-consumable anode assembly 82 is provided which has a number of through plating solution apertures 86. These apertures are of the order of 5/16" in diameter and form a primary plating flow path 80 to bathe the strip 12. These apertures collectively provide about 30% open area through the anode. The non-consumable anode 82 is suspended above the position of the strip 12 and is maintained in close spaced apart relationship. A non-conducting frame 88 supports the non-consumable anode and has walls sounding a consumable anode 92. A contact bar 90 serves as a convenient method of attaching the non-consumable anode to a DC source of electrical potential for maintaining plating current flow.

The upper non-conducting frame 88 may include an opening at its top. The lower non-conducting frame on the other hand, preferably includes a bottom **89*b*** to assure that the lower consumable anode is immersed in plating solution.

In the embodiment illustrated, the conduit 68 is fitted with horizontal stem pipes 67 which contain ¼" apertures 69. The stem pipes 67 are positioned along the side of the flow pathes 80 between the strip and the non-consumable anodes to deliver a continuous supply of electroplating solution to the flow path. Solution flows over and off the workpiece in the manner described more completely in the referenced application.

Each consumable anode 92 is rectangular in shape and positioned in a cavity defined by its associated frame 88 and non-consumable anode. Each is at least partially immersed in plating solution which flows to the strip along a second flow path 94.

The upper and lower consumable anodes are suspended above and below the non-consumable anode assemblies 82 by means of non-conducting frames 96 which cradle the anodes 92 and help maintain contact bars 98 in place. The conduit 68 is fitted with stem pipes 97 containing ¼' apertures 99. The stem pipes 97 are respectively positioned along the sides of the spaces between consumable anodes 92 and the apertured wall of the non-consumable anode assembly 82.

As the strip 12 moves horizontally within the cell 50 a first potential is applied between the strip and the non-consumable anode 82 and a second potential, which is at least as great as the first, is applied between the strip and the consumable anode 92. The consumable anode undergoes electrochemical dissolution to provide zinc ions to solution flowing over it while the distance between the non-consumable anode assembly and the strip is maintained. Thus electroplating solution with high ion concentrations bathes the srip surface while consistant electroplating current density is maintained across the strip surface providing an even and uniform coating of metal.

The fluid flow through pipe 68 can be adjusted to alter the fluid flow through the stem pipes 67 and 97. Higher pressure results in greater fluid flow around the anodes and insures that the gap between the workpiece and the anodes receives fresh plating solution to maintain metal plating ion concentration during the plating operation. Stop cocks and other regulatory valve devices can be utilized to create an electroplating solution flow differential between and around the configured anode system to more accurately control the plating operation and assure a good flow of solution through appertures 86 in non-consumable anode 82.

It will also be realized that tree growth and edge buildup can occur when the plating solution is allowed free flow from the anode around the strip. So-called tree growth occurs along the edge of the workpiece which degrades the plating near the edge. The edge builup is a phenomenon where microscopic nodules appear along the workpiece edges and result in a nonuniform plating.

Figure 4:
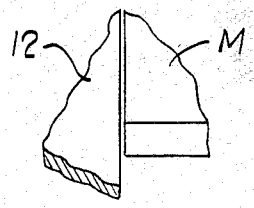
FIG. 4 is a fragmentary sectioned view of a workpiece strip and a masking plate.

By masking off a portion of the current flow with masking plates, one of which is shown schematically as in FIG. 4, it is possible to control this phenomenon. During plating the masking plates are positioned so that their edge surfaces are closely spaced with the edge surfaces of the workpiece. With the masking plates in this position it has been observed that neither the trees nor the nodules appear along the edge of the workpiece. Excess plating deposition on or close to the strip edge is permitted because current path is not continuous beyond the strip edge.

The consumable anode dissolves both chemically and electrolytically providing at least a substantial portion of the zinc ions required. With zinc electrochemical dissolution provides on the average of about 40% of the zinc ion required for plating. Chemical dissolution of the zinc anode bed provides additional zinc ion depending upon the pH. At pH 1.0 up to 50% of the zinc required for plating is provided by chemical dissolution of the consumable zinc anode bed.

Preferably the pH of the plating bath during plating is from about 1.0 to about 2.5. It has been found that when using a zinc consumable anode at a pH of about 1.0, upwards of about 90% of the zinc ion can be replenished by the consumable anode. The actual amount of ion replenishment will vary depending on current density, the plating metal and the like. The remainder of the metal plating ion is replenished by the replenishment reservoir.

The potential difference between the consumable anode and non-consumable anode assembly affects the current flow between the consumable anode and the strip thus effecting the rate of metal dissolution. The current to the non-consumable and consumable anode is generally independently controlled to produce a desired total current density or electroplating density at the strip. Generally the potential difference between the consumable anode and non-consumable anode assembly is controlled between about 0.1 to about 4.0 volts with the potential between the consumable anode and the strip always having a potential at least as great as that between the non-consumable anode and the strip.

There is a limit to the effective use of the potential difference between the consumable anode and non-consumable anode assembly to increase the consumable anode disolution rate. At potentials above a threshold potential difference, metal begins to deposit on the non-consumable anode facing the consumable anode. This deposition or bi-polar effect will occur at different anode potentials depending upon the design of the non-consumable anode assembly. For example, deposition on a "wire grid" configured non-consumable anode occurs at about 4 volts differential, wherein deposition on the "flat frame" configured non-consumable anode occurs at about 2 volts differential.

In use the relative potential difference between the anodes and the workpiece should be regulated so that zinc deposition on the non-consumable anode assembly is minimized. Such zinc deposition is deleterious to the continuous plating operation representing lost current. Additionally trees will form on the non-consumable anode which may grow back to the consumable anode causing a short circuit. In continuous operation it is preferred to limit the potential difference between the anodes to about 2 volts.

The following examples are given by way of illustration of the nature of the instant invention but are not intended to be limitation of the scope thereof.

EXAMPLE I

In this example non-consumable anodes with varying perforation designs were evaluated. An NDS coating thickness guage was used to measure the zinc deposit thickness at three different locations along the cathodic workpiece in the test cell in order to predict the distribution across a moving strip.

Figure 5:
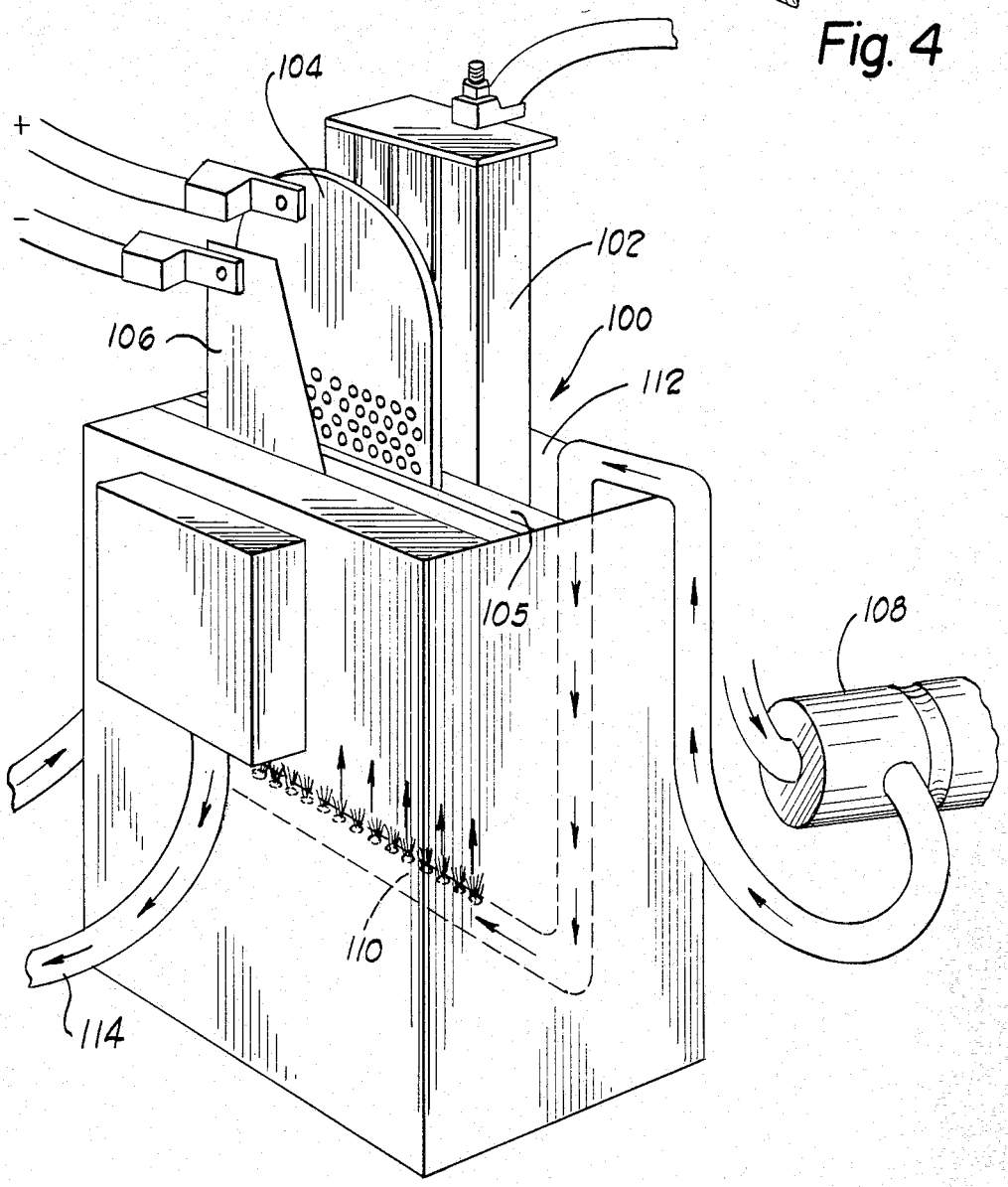
FIG. 5 illustrates schematically a vertical electroplating cell.

A vertical plating test cell illustrated in FIG. 5 was used. This cell comprised a cell vessel 100 containing a consumable zinc anode 102, an apertured non-consumable lead anode assembly 104, and a cathodic workpiece 106 parallel to and spaced from the anodes. The lead anode was inserted into an insulating holder 105 to prevent zinc deposition on the edges and to insure rigid position control. The holder had an open area equal to the overall exposed area of the non-consumable anode of approximately 0.035 square meters from the maintained levels of solution to the bottom.

The vessel was filled with an aqueous zinc sulfate plating solution containing 90 grams of zinc per liter at pH 1.0 and maintained at 55° C. The plating solution was circulated at a rate of 45 liters per minute by means of an overflow outlet at the top of the vessel connected to a plating solution distributor tube running beneath the consumable anode inside the vessel.

Two separate adjustable power sources were utilized to provide current individually to the consumable anode and the non-consumable anode. The potential between the consumable anode and the metallic workpiece was maintained at 9.5 volts and the potential between the non-consumable anode and the workpiece was maintained at 7.5 volts to yield a total current (cathode current density) of 5400 amps per square meter.

A pump 108 was used to circulate plating solution from a replenishment tank, not shown to a distribution manifold 110. Solution was delivered into a chamber 112 in which the consumable anode was at least partially submerged, thence through the apertures of the non-consumable to an outlet conduit 114. Flow rates were maintained at 15 gallons per minute.

Four non-consumable anode designs were tested utilizing the above described test cell. The results of the tests of designs A–D are shown in Table 1. Design A utilized a system of equispaced circular holes creating a 27% open area. Design B utilized a system of elongated parallel bars, each bar having an open space 1.3 cm wide for a total of 50% open area. Design C utilized a grid system wherein intersecting lead wire (0.32 cm in diameter) was used to create a matrix having 61% open area. Design D utilized a grid system wherein the intersecting lead wire (0.32 cm in diameter) was used to create a mesh having 42% open area. As the non-consumable anode open area increased, the fraction of the current from the consumable anode also increased. Too large an open area decreased the uniformity of zinc deposit. Design D with 42% open area provided maximum zinc replenishment from the consumable anode bed while also providing an acceptable uniformity of zinc deposit. Design D is preferred for the reasons stated above.

TABLE 1

COMBINATION ANODE PERFORMANCE AFFECTED BY NON-CONSUMABLE ANODE DESIGN

| Non-Consumable Anode Design | Percent Open Area | Percent of Current From Consumable Anodes | Percent Coating Thickness Variation |
|---|---|---|---|
| A (Holes) | 27 | 18 | 3.1 |
| B (Slots) | 50 | 25 | — |
| C (Wire Grid) | 61 | 38 | 6.1 |
| D (Wire Grid) | 42 | 34 | 2.8 |

This example indicates the relationship of the non-consumable anode assembly design to cell performance in accordance with the instant inventive process.

EXAMPLE II

In this example, the effect of the potential difference between the consumable and non-consumable anodes on the electrochemical dissolution of the consumable anode, as a function of the total cathodic current density, is demonstrated. The results are shown in Table 2.

TABLE 2

PERCENT OF TOTAL CURRENT FROM SOLUBLE ANODE DESIGN D
Soluble-Insoluble Anode Distance = 9.5 MM
Insoluble Anode-Cathode Distance = 9.5 MM

| Consumable-Non-consumable Anode Potential Difference (Volts) | Total Cathode Current Density ($A/m^2$) | Percent of Total Current from Consumable Anode |
|---|---|---|
| 0.0 | 1080 | 100 |
| 0.0 | 2160 | 63 |
| 0.0 | 5400 | 31 |
| 0.0 | 10800 | 20 |
| 2.0 | 1080 | 100 |
| 2.0 | 2160 | 100 |
| 2.0 | 5400 | 51 |
| 2.0 | 10800 | 29 |
| 4.0 | 1080 | 100 |
| 4.0 | 2160 | 100 |
| 4.0 | 3730 | 100 |
| 4.0 | 5400 | 73 |
| 4.0 | 10800 | 41 |

As shown in Table 2, the fraction of total current (i.e. ion flow) from the consumable anode bed decreases with increasing cathodic current density (rate of zinc deposition) as a result of current proportioning between the anodes. At high cathodic current densities, the non-consumable anode path has the smaller resistance. Test results showed that the fraction of zinc ions supplied by electrochemical dissolution of the consumable anode increases as total cathodic current density decreases for a given potential difference.

EXAMPLE III

This example demonstrates that electrochemical dissolution of the consumable anode bed increases with increasing potential difference between the consumable and non-consumable anodes. Using the test apparatus of Example I, the consumable anode was positioned 9.5 mm from the non-consumable anode and the non-consumable anode was positioned 9.5 mm from the cathode. Various tests were made at differing total cathode current at the potential differences between the consumable and non-consumable anodes are shown in Table 3.

As can be seen, the potential difference between the consumable and non-consumable anodes has the greatest effect on the consumable anode current and, thus the zinc dissolution rate. This example shows that increasing the potential difference between the anodes generally causes an increase in the electrochemical dissolution of the consumable anodes. The change is greater for small cathodic current densities than for the larger cathodic current densities. It was noted that the potential differences could not be increased beyond a threshold potential difference to obtain ever-increasing consumable anode current. Deposition of zinc on the non-consumable anode begins to occur at these threshhold potential differences. The threshhold potential difference was found to vary as a function of non-consumable anode design.

EXAMPLE IV

In this example, the distance between the consumable and non-consumable anodes was varied. As in Example III, the non-consumable anode/cathode distance was maintained at 9.5 mm while the consumable/non-consumable anode distance was reduced to 3.2 mm. The potential difference between the anodes was maintained at 0.0. The results are shown in Table 4.

This example shows that changing the distance between the anodes has little effect on the consumable anode current as well as the total cathode current.

EXAMPLE V

In this example the distance between the consumable and non-consumable anodes was maintained at 3.2 mm as in Example IV while the distance between the non-consumable anode and the cathodic workpiece was increased to 19.0 mm. The results are shown in Table 5.

TABLE 3

CURRENT/POTENTIAL PERFORMANCE OF THE COMBINED ANODE SYSTEM DESIGN D
Soluble-Insoluble Anode Distance = 9.5 MM
Insoluble Anode-Cathode Distance = 9.5 MM

| Consumable/ Nonconsumable Anode Potential Difference (Volts) | Consumable Anode/Cathode Potential Difference (Volts) | Nonconsumable Anode/Cathode Potential Difference (Volts) | Consumable Anode Current (Amps) | Nonconsumable Anode Current (Amps) | Total Cathode Current (Amps) |
|---|---|---|---|---|---|
| 0.0 | 4.5 | 4.5 | 40 | 10 | 50 |
| 0.0 | 6.0 | 6.0 | 48 | 50 | 98 |
| 0.0 | 8.0 | 8.0 | 52 | 100 | 152 |
| 0.0 | 10.0 | 10.0 | 58 | 150 | 208 |
| 0.0 | 12.0 | 12.0 | 60 | 200 | 260 |
| 0.0 | 13.5 | 13.5 | 65 | 250 | 315 |
| 2.0 | 7.5 | 5.5 | 75 | 10 | 85 |
| 2.0 | 9.5 | 7.5 | 80 | 50 | 130 |
| 2.0 | 11.5 | 9.5 | 85 | 100 | 185 |
| 2.0 | 13.5 | 11.5 | 90 | 150 | 240 |
| 2.0 | 15.0 | 13.0 | 95 | 200 | 295 |
| 2.0 | 17.0 | 15.0 | 100 | 250 | 350 |
| 4.0 | 11.0 | 7.0 | 115 | 10 | 125 |
| 4.0 | 12.5 | 8.5 | 125 | 50 | 175 |
| 4.0 | 14.5 | 10.5 | 130 | 100 | 230 |
| 4.0 | 16.0 | 12.0 | 132 | 150 | 282 |
| 4.0 | 18.0 | 14.0 | 135 | 205 | 340 |
| 4.0 | 19.5 | 15.5 | 140 | 250 | 390 |

TABLE 4

CURRENT/POTENTIAL PERFORMANCE OF THE COMBINED ANODE SYSTEM DESIGN D
Soluble-Insoluble Anode Distance = 3.2 MM
Insoluble Anode-Cathode Distance = 9.5 MM

| Consumable/ Nonconsumable Anode Potential Difference (Volts) | Consumable Anode/Cathode Potential Difference (Volts) | Nonconsumable Anode/Cathode Potential Difference (Volts) | Consumable Anode Current (Amps) | Nonconsumable Anode Current (Amps) | Total Cathode Current (Amps) |
|---|---|---|---|---|---|
| 0.0 | 5.0 | 5.0 | 45 | 10 | 55 |
| 0.0 | 6.5 | 6.5 | 55 | 50 | 105 |
| 0.0 | 9.0 | 9.0 | 60 | 100 | 160 |
| 0.0 | 11.0 | 11.0 | 60 | 150 | 210 |
| 0.0 | 13.0 | 13.0 | 65 | 200 | 265 |
| 0.0 | 14.5 | 14.5 | 68 | 255 | 323 |

This example shows that cathode current dropped for a given voltage but acceptable plating currents were maintained even at large non-consumable anode to cathode distances.

EXAMPLE VI

Utilizing the test apparatus of Example I, the electrode spacing was varied in order to determine the effect on electrochemical dissolution of the consumable anode bed. In the first test, the consumable anode was positioned 3.2 mm from the non-consumable anode while the non-consumable anode was positioned 9.5 mm from the cathodic sheet. In the second test, the anode-to-anode distance remained 3.2 but the anode-to-cathode distance was changed to 19.0 mm. In the final test, the anode-to-anode and the anode-to-cathode distances were each 9.5 mm. As shown in Table 6, no specific trend in percent of total current from the soluble anode could be discerned.

TABLE 6

PERCENT OF CURRENT FROM SOLUBLE ANODES AFFECTED BY ELECTRODE SPACING DESIGN D
Cathode current Density = 5400 A/m$^2$

| Consumable-Non-Consumable Anode Spacing (mm) | Non-Consumable Anode-Cathode Spacing (mm) | Percent of Current from Consumable Anodes |
|---|---|---|
| 3.2 | 9.5 | 36 |
| 3.2 | 19.0 | 38 |
| 9.5 | 9.5 | 32 |

TABLE 5

CURRENT/POTENTIAL PERFORMANCE OF THE COMBINED ANODE SYSTEM DESIGN D
Soluble-Insoluble Anode Distance = 3.2 MM
Insoluble Anode-Cathode Distance = 9.5 MM

| Consumable/ Nonconsumable Anode Potential Difference (Volts) | Consumable Anode/Cathode Potential Difference (Volts) | Nonconsumable Anode/Cathode Potential Difference (Volts) | Consumable Anode Current (Amps) | Nonconsumable Anode Current (Amps) | Total Cathode Current (Amps) |
|---|---|---|---|---|---|
| 0.0 | 6.0 | 6.0 | 50 | 10 | 60 |
| 0.0 | 9.0 | 9.0 | 58 | 50 | 108 |
| 0.0 | 12.0 | 12.0 | 62 | 100 | 162 |
| 0.0 | 15.0 | 15.0 | 68 | 150 | 218 |
| 0.0 | 18.0 | 18.0 | 70 | 200 | 270 |

This example shows that relative anode-to-anode and anode-to-cathode spacing does not significantly alter the electrochemical dissolution of the consumable anode

EXAMPLE VII

This example shows that electrochemical dissolution of the consumable anode bed increases as the pH of the electrolyte solution decreases. Utilizing the test apparatus in Example I, the pH of the electrolyte was varied from 2.0 to 1.0. As shown in Table 7, as the pH of the electrolyte decreased, the percent of total current from the consumable anodes increased.

TABLE 7

ELECTROCHEMICAL DISSOLUTION AFFECTED BY pH DESIGN D
CATHODE CURRENT DENSITY
5400 Amps/m$^2$

| pH | Percent of Total Current from Consumable Anodes |
|---|---|
| 2.0 | 32 |
| 1.0 | 40 |

This example shows that with a change in current from the consumable anode, as a function of decreasing pH there is an increase in the electrochemical dissolution rate.

EXAMPLE VIII

Utilizing the test equipment of Example I and applying an equal amount of current to each anode to produce a cathodic current density of 5400 A/m$^2$, the pH of the electrolyte was varied from 1.0 to 2.0 to determine the effect of pH on the chemical dissolution of the consumable anode bed. Chemical dissolution was measured by the taking the difference in the calculated bath concentration and the actual bath concentration for a specific time interval. The zinc concentration of the electrolyte bath using a non-consumable anode alone was calculated to decrease by 6.4 gram/liter after 40 minutes of continuous electroplating. Using the combined anode system with only an electrochemical dissolution of the consumable anode, it was calculated that the zinc concentration in the electrolyte should have decreased 3.2 gram/liter after 40 minutes of continuous plating. At electrolyte pH 2.0 the zinc concentration decreased 1.3 gram/liter indicating that 50% of the zinc for plating was supplied by electrochemical dissolution and 30% was supplied by chemical dissolution. At electrolyte pH 1.0 the zinc concentration remained unchanged after 40 minutes indicating that all the zinc required for plating was supplied by anode bed dissolution. This example shows the combined effect of the chemical and electrochemical dissolution of the consumable anode as a function of plating solution pH.

EXAMPLE IX

In this example the power consumption of the combined anode system of the test apparatus was compared with the power consumption of similar systems utilizing either an non-consumable anode or a consumable anode alone. Typical power consumption of laboratory bench systems are shown below in Table 8 for comparative purposes. The combined system was compared with a non-consumable anode system wherein the non-consumable anodes in each system were spaced 9.5 mm from the cathodic workpiece. The combined anode system was compared with a consumable anode system. As shown in Table 8 the combined anode system required no more power than either single anode system. Moreover, at the higher cathodic current densities, the power consumption of the combined anode system was equal to or less than the power consumption of a non-consumable anode system.

TABLE 8

| POWER CONSUMPTION WITH OPTIMUM ELECTRODE SPACING DESIGN D | | | | |
|---|---|---|---|---|
| Cathode Current Density ($A/m^2$) | Potential Between Consumable & Nonconsumable Anodes (Volts) | Consumable Anode(1) Alone (Watts) | Nonconsumable Anode Alone(2) (Watts) | Combination Anode System(3) (Watts) |
| 5400 | 0.0 | 1800 | 1600 | 1400 |
| 8100 | 0.0 | 4100 | 3200 | 2900 |
| 10800 | 0.0 | 7300 | 5400 | 4700 |
| 5400 | 2.0 | N.A. | N.A. | 1700 |
| 8100 | 2.0 | N.A. | N.A. | 3100 |
| 10800 | 2.0 | N.A. | N.A. | 5100 |
| 5400 | 4.0 | N.A. | N.A. | 1900 |
| 8100 | 4.0 | N.A. | N.A. | 3200 |
| 10800 | 4.0 | N.A. | N.A. | 5000 |

(1)Anode-Cathode spacing = 19.0 mm
(2)Anode-Cathode Spacing = 9.5 mm
(3)Soluble-Insoluble Anode Spacing = 9.5 mm Insoluble Anode-Cathode spacing = 9.5 mm To attain an increase of four volts potential difference between the consumable and non-consumable anodes, the combined anode system required an increase of power of between 200 and 400 watts (6 to 8 percent).

This example shows that the combined system of the instant invention requires no more power than a non-consumable anode system alone.

EXAMPLE X

In this example the uniformity of zinc deposition produced by the combined anode system of test apparatus of Example I was compared with the coating produced when only a consumable anode is used. When zinc was plated with the test apparatus minus the non-consumable anode assembly, the consumable anode developed a nonuniform profile as dissolution occurred, producing a nonuniform coating with a thickness variation of 29%. By insertion of a non-consumable anode assembly in accordance with the instant invention, the coating produced had a thickness variation of only 8.3% between maximum and minimum thicknesses.

EXAMPLE XI

In this example the test apparatus of Example I was utilized, substituting an insulating perforated plastic sheet for the non-consumable anode assembly to determine whether the non-consumable anode performed solely as a current diffuser. The coating produced when the plastic insert was used had a thickness variation of 20% as compared with the 8.3% variation of Example X when the combined anode system was employed. The example shows advantages of the combined non-consumable/consumable anode system of the instant invention.

EXAMPLE XII

In this example, the variation of the deposit coating thickness between maximums and minimums was measured as a function of anode-to-anode and anode-to-cathode spacing. Using the test apparatus of Example I the anodes and the cathodic workpiece were spaced as shown in Table 9.

TABLE 9

| VARIATION OF COATING THICKNESS DUE TO ELECTRODE SPACING | | |
|---|---|---|
| Consumable-Non-consumable Anode Distance (mm) | Non-consumable Anode-Cathode Distance (mm) | Percent Coating Thickness Variation |
| 3.2 | 9.5 | 3.4 |
| 3.2 | 19.0 | 2.3 |
| 9.5 | 9.5 | 3.4 |

This example shows that electrode spacing did not significantly alter the uniformity of the deposit distribution.

Although the invention has been described in its preferred form with a certain degree of particularity, it is understood that the present disclosure of the preferred form has been made only by way of example and that numerous changes in the details of construction and the combination and arrangements of parts may be resorted to without departing from the spirit and the scope of the invention, as hereinafter claimed.

We claim:

1. An apparatus for electroplating at least one surface of a cathodic workpiece in an electrolytic cell comprising:

(a) a structure defining a workpiece position;

(b) a non-consumable anode having a plate with apertures therethrough positioned in a spaced apart relationship with respect to the workpiece plating position and in part defining a first plating solution flow path between the workpiece position and the plate; said non-consumable anode contoured to maintain a substantially uniform spacing between a substantially planar surface of said anode and a substantially planar workpiece plating surface;

(c) a consumable anode positioned outside the first plating solution flow path, in a spaced apart relationship with respect to the workpiece position to define a second solution flow path between the consumable anode and the workpiece through the spaced apertures in said non-consumable anode plate, the relative positioning of the non-consumable and consumable anodes such that said second flow path at least partially co-incides with said first flow path in a region between the apertured plate and said workpiece position;

(d) fluid supply means for supplying an electroplating solution that substantially fills the first and second plating solution flow paths by directing solution past the consumable anode to and through said spaced apertures to permit electroplating current flow between a workpiece and each of the anodes; and, (e) a power supply for applying a direct current potential between a workpiece and each of the anodes such that the direct current potential between such workpiece and the non-consumable anode is no higher than that between the consumable anode and such workpiece.

2. The apparatus of claim 1 wherein the power supply is adapted to supply direct current potential between the cathodic workpiece and the consumable anode higher than that between the non-consumable and the workpiece.

3. The apparatus of claim 1 further comprising replenishment means for replenishing the metal plating ion in the electroplating solution in addition to the consumable anode.

4. A method for electroplating at least one planar surface of a cathodic workpiece in an electrolytic cell containing a non-consumable anode having a plate with apertures extending therethrough in a spaced apart relationship with said planar workpiece surface to be plated to define a first plating solution flow path between the workpiece and the plate, and a consumable anode, positioned outside the first plating solution flow path in a spaced apart relationship with the workpiece with a second plating solution flow path defined between the consumable anode and the workpiece through the apertures in the non-consumable anode plate, said second plating solution flow path at least partially co-inciding with the first flow path in the region between the apertured plate and the workpiece; said method comprising the steps of:

(a) substantially filling the first and second flow paths with electroplating solution containing metal plating ions by flowing solution past the consumable anode to and through said apertures to said workpiece surface;

(b) establishing electroplating current flow between the workpiece and each of the anodes by applying direct current potential between the workpiece and each of said anodes;

(c) plating the workpiece surface while maintaining the direct current potential between the workpiece and the non-consumable anode at a value less than that between the consumable anode and the workpiece; and, (d) adjusting the relative potentials of said anodes to maximize plating efficiency without plating deleterious amounts of metal onto the non-consumable anode.

5. An electroplating assembly for plating a surface of a steel workpiece comprising:

(a) structure defining a position for placement of a workpiece during a plating operation;

(b) a non-consumable anode assembly positioned in closely spaced relationship with the workpiece position and including a non-consumable anode with a surface oriented toward the workpiece position of a contour corresponding to the contour of the workpiece position whereby the workpiece and the non-consumable anode surface will be in predetermined spaced relationship during the plating operation so that a desired current density can be maintained across the workpiece;

(c) the non-consumable anode assembly including structure defining a chamber for containing plating solution with the interior of the chamber being in fluid communication with the workpiece position through said apertures extending through said non-consumable anode which at least in part forms a wall of the chamber;

(d) a consumable anode positioned in the chamber in non-contacting relationship with the non-consumable anode for supplying replenishment ions to the solution and participating in the plating operation; and (e) power supply means connected to both the consumable and the non-consumable anode and adapted to maintain the potential between the consumable anode and a workpiece being plated at least as high as the potential between the non-consumable anode and such workpiece.

6. The assembly of claim 5 wherein the power supply means is adapted to maintain the potential between the consumable anode and the workpiece higher than the potential between the non-consumable anode and the workpiece.

7. The assembly of claim 5 wherein said non-consumable anode surface is generally horizontal and above the workpiece.

8. The assembly of claim 5 wherein said non-consumable anode surface is generally horizontal and below the workpiece.

9. The assembly of claim 5 wherein the non-consumable anode surface is oriented in a non-horizontal attitude.

10. The assembly of claim 9 wherein the non-consumable anode surface is substantially vertical.

11. A process of plating a surface of a steel workpiece with a metal comprising:

(a) positioning an anode chamber in which a non-consumable anode at least in part forms a wall of the chamber in spaced relationship with a workpiece with the non-consumable anode having a surface oriented toward a surface to be plated of the workpiece and maintained in a predetermined spacial relationship with the workpiece surface such that a desired and predetermined current density can be achieved across the workpiece surface;

(b) positioning a consumable anode in the anode chamber in non-contacting relationship with the non-consumable anode and with the non-consumable anode between the consumable anode and the workpiece surface;

(c) flowing plating solution into said chamber and through apertures in said non-consumable anode into contact with the workpiece;

(d) maintaining the flow at sufficient volume to substantially fill at least a portion of the space between the non-consumable anode surface and the workpiece surface being plated and to maintain the consumable anode at least partially immersed in such solution;

(e) establishing electroplating current flow between the workpiece and each of the anodes by applying direct current potential between the workpiece and each of said anodes, and plating the workpiece surface while maintaining the potential between the consumable anode and the workpiece at least as high as the potential between the non-consumable anode and the workpiece.

12. The process of claim 11 wherein the potential between the consumable anode and the workpiece is maintained higher than the potential between the non-consumable anode and the workpiece.

13. The process of claim 11 wherein the workpiece and non-consumable anode surfaces are spaced uniformly.

14. A strip plating system comprising:

(a) drive means for propelling the strip along a path;

(b) two anodes, one consumable and the other non-consumable said non-consumable anode having a plate with apertures therethrough;

(c) mounting structure for supporting the two anodes spaced from the same side of the strip and in a mutually superposed non-contacting relationship with the non-consumable anode plate mounted closer to the strip path;

(d) apparatus for delivering plating fluid to a space between said two anodes to cause fluid to flow through said apertures and substantially fill a space between the plate and the strip; and (e) power circuitry for maintaining an electrical potential difference between the strip and the anodes.

15. The apparatus of claim 14 wherein the apparatus for delivering plating fluid substantially fills the spaces between each anode and the strip as plating occurs.

16. The apparatus of claim 14 wherein the power circuitry maintains a potential between the strip and non-consumable anode no higher than between the consumable anode and the strip.

* * * * *